US005301737A

United States Patent [19]

Martin

[11] Patent Number: 5,301,737

[45] Date of Patent: Apr. 12, 1994

[54] SCREEN INSERT FRAME

[75] Inventor: William D. Martin, Taylorsville, Utah

[73] Assignee: All Weather Steel Products Co., Inc., Salt Lake City, Utah

[21] Appl. No.: 888,728

[22] Filed: May 19, 1992

[51] Int. Cl.[5] ..... A47G 5/00

[52] U.S. Cl. ..... 160/380; 160/395

[58] Field of Search ..... 160/380, 369, 371, 392, 160/395, 399, 402, 383

[56] References Cited

U.S. PATENT DOCUMENTS

| | | | |
|---|---|---|---|
| 1,212,676 | 1/1917 | Porter . | |
| 1,350,027 | 8/1920 | Lane | 160/392 X |
| 1,758,720 | 5/1930 | Sodergren | 160/392 |
| 2,335,361 | 11/1943 | Schiller | 160/395 |
| 2,436,277 | 2/1948 | Willett . | |
| 2,627,311 | 2/1953 | Kaufmann | 160/395 |
| 2,709,489 | 5/1955 | Keebler | 160/395 X |
| 2,835,325 | 5/1958 | Gilbert et al. | 160/395 X |
| 3,086,628 | 4/1963 | Robinson . | |
| 3,220,469 | 11/1965 | Oehmig . | |
| 3,379,237 | 4/1968 | Worthington | 160/391 X |
| 3,696,857 | 10/1972 | Tarte . | |
| 3,729,045 | 4/1973 | MacDonald | 160/395 X |
| 4,084,360 | 4/1978 | Reckson . | |
| 4,603,724 | 8/1986 | Borwick . | |
| 5,012,616 | 5/1991 | Martin . | |

*Primary Examiner*—David M. Purol
*Attorney, Agent, or Firm*—Thorpe, North & Western

[57] ABSTRACT

A screen enclosure device comprising a first frame member having an interior face and a second frame member having an interior face wherein the first and second frame members are configured to join at their interior faces to form a single frame structure. Serrated contacting structure including a plurality of rows of teeth extends substantially along and is interposed in contacting relationship between the substantial full perimeter of the opposing faces of these first and second frame members. Screen material is drawn tightly across the opening of the frame and is retained in this tight configuration by forces supplied by the serrated contacting structure in its sandwiched configuration between the opposing faces of the first and second frame members.

17 Claims, 1 Drawing Sheet

SCREEN INSERT FRAME

BACKGROUND OF THE INVENTION

1. Field of the Invention

This invention relates to screen inserts for doors and windows and more particularly to rigid screen inserts which sandwich the screen material between opposing frame members.

2. Prior Art

The use of screen material in doors and windows has been popular for decades for providing air flow into a room while preventing entry of insects and wind born debris. In window applications, screen material may be easily mounted on a frame which is positioned in a window opening and usually does not require special mounting structure to maintain its proper placement.

Screen inserts which are positioned in doors, however, are subject to more stringent conditions. For example, it is not uncommon for persons exiting a room to push on the screen insert for the purpose of opening the door as they exit. Most screen inserts are not adapted with structure to prevent the force applied to the screen material from displacing the screen from its point of attachment. Where young children are involved, the applied force to the screen material may be quite severe and may quickly lead to full detachment of the screen material.

The most common means for mounting screen material into an opening of a screen insert frame involves a peripheral channel formed in the frame which is sized to receive a smaller diameter rubber insert which captures the screen material within the channel when the insert is pressed therein. This offered the advantage of enabling simple repair following displacement by merely re-stretching the screen across the opening of the insert and repositioning the components to their original configuration.

Numerous improvements have been attempted to make screen attachments more permanent and stable. U.S. Pat. Nos. 1,212,676; 3,086,628 and 3,696,857 disclose a series of improvements which involve capturing the screen at a single gripping edge. In these instances, the screen material is stretched to a taught configuration and the gripping edge is applied against the frame, with the screen sandwiched therebetween. The disadvantages of this method of attachment include tearing of the screen material under nominal force and loss of tension in the screen stretched across the insert opening. This arises in part because of the localized stress which is totally focused along the gripping edge.

A second method for securing the screen material within the insert opening is represented by U.S. Pat. Nos. 2,436,277; 3,220,469; and 4,084,360. These three patents are representative of techniques which involve sandwiching the screen material between opposing plates which are compressed to grip the screen material therebetween. Essentially, opposing flat surfaces frictionally grip the screen material as they are forced toward each other. Several of these patents suggest the utility of having an arcuate configuration in which an insert portion extends into the arcuate cavity such that linear force applied along the screen material is resisted primarily at the juncture of a plane containing the screen material and a deviation of this screen as it wraps through the arcuate cavity, held by the inserted structure which is compressed against the screen. This prior art shows a number of variations of quick release, clip-on structure which facilitates removal of the opposing frame members such that the sandwiched screen can be repositioned in a taut configuration, with the opposing frame members being reconnected to grip the screen securely.

Although these various improvements have enhanced the ability of the screen material to resist strong forces applied, even these configurations will release or permit the screen to loosen when subjected to sever forces. In fact, if steel screen material is applied, its ability to survive extreme impacts results in the peripheral edges of the screen being pulled free from the support structure. What is needed is a different support system which has sufficient strength to resist release of the screen material from its sandwiched position, even with sever blows.

OBJECTS AND SUMMARY OF THE INVENTION

It is therefore an object of the present invention to provide a screen insert wherein the frame enables secure attachment of steel screen or other screen of similar strength within a frame configuration which does not release the screen material, even with sever forces applied.

Yet another object of the present invention is to provide an inexpensive screen door insert which is capable of use within door openings frequented by young children who may carelessly apply a running force against the screen material to push the door open.

These and other objects are realized in a screen enclosure which includes a first frame member surrounding an opening, wherein the frame member has an exposed face and opposing face on an opposite side thereof for abutting against a second frame member. The second frame member has a size corresponding to the first frame member and includes an exposed face and an opposing face on an opposite side thereof for abutting against the opposing face of the first frame member when the two frame members are coupled together to form a single frame. Serrated contacting structure including a plurality of rows of teeth extends along and is interposed in contacting relationship between the full perimeter of the opposing faces of the first and second frame members. Screen material is drawn tight across the opening of the frame and is retained in this tight configuration by direct contact with the serrated contacting structure interposed between the opposing faces of the first and second frame members. Additional structural features are disclosed with respect to gripping the sandwiched screen material, as well as storing a peripheral edge of the screen within and between the contacting frame members.

Other objects and features of the present invention will be apparent to those skilled in the art, taken in combination with the accompanying drawings.

DETAILED DESCRIPTION OF THE INVENTION

Figure 1:
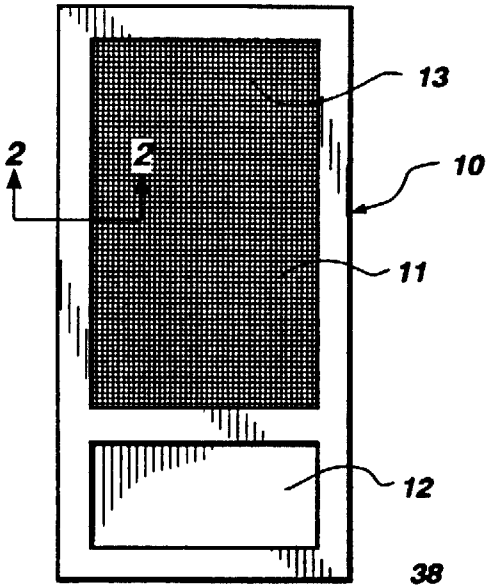
FIG. 1 shows a front plan view of a screen insert with screen material mounted in accordance with the teachings of the present invention.

Referring now to the drawings:

FIG. 1 shows a screen insert which may be inserted into a storm door in a conventional manner. A device of similar appearance is disclosed in U.S. Pat. No. 5,012,616 by the present inventor and is illustrative of the appearance of various types of screen inserts available in the marketplace.

The screen insert shown in FIG. 1 includes a frame 10 and screen material 11 which is stretched within the frame in tight configuration. A solid plate 12 is illustrated in the lower opening, with the frame member 10 comprising an integral structure. The novelty of the present invention lies in the method in which the screen material 11 is captured and retained in the tight configuration within the frame 10.

Figure 2:
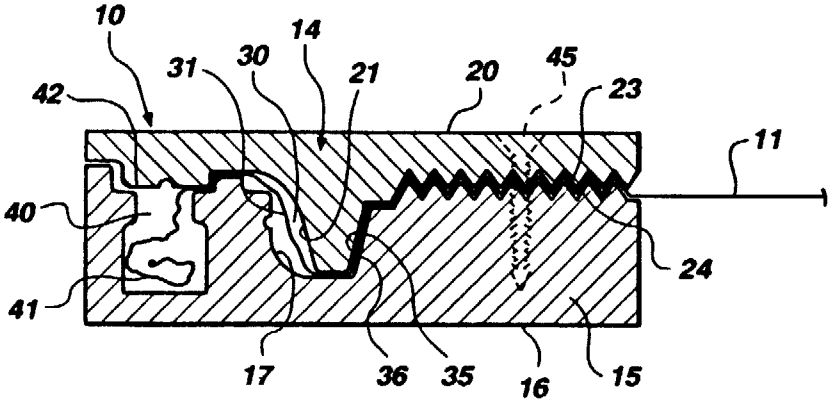
FIG. 2 shows a cross section taken along the lines 2—2 of FIG. 1.
Figure 3:
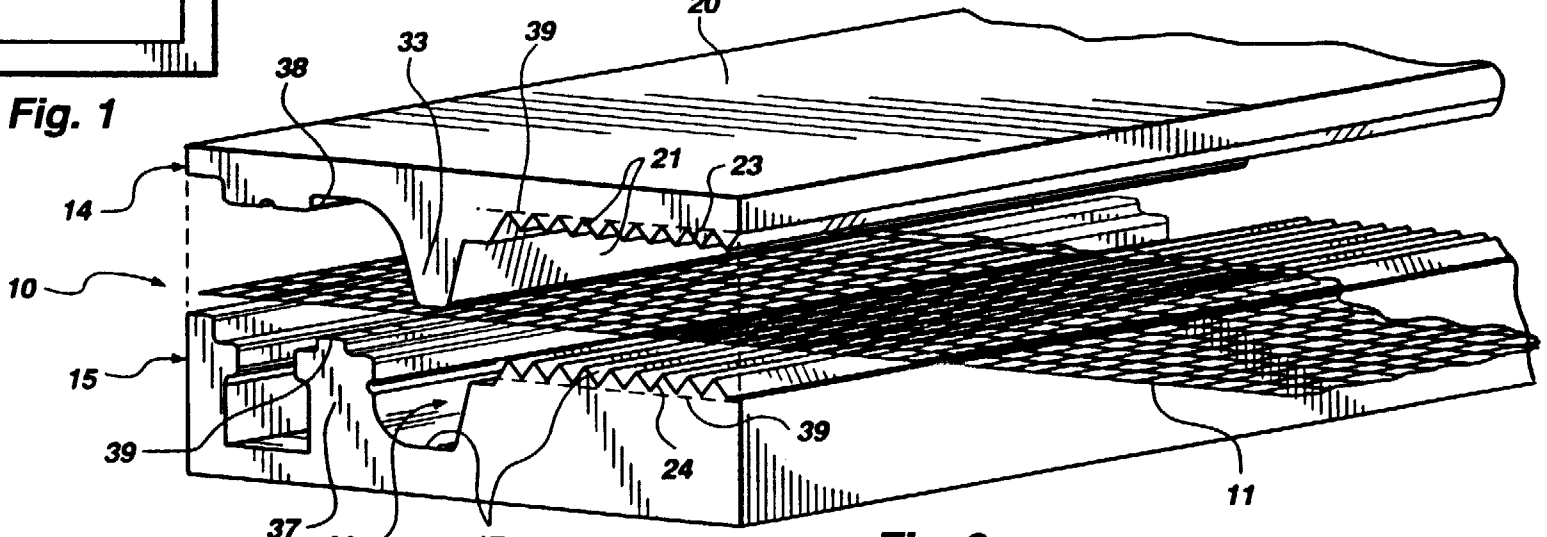
FIG. 3 is an exploded, perspective view of a section of the surrounding frame members and captured screen material.

The screen material is illustrated respectively in FIGS. 2 and 3 in a captured configuration and in a preassembled configuration respectively. FIG. 2 also illustrates the use of respective frame members 14 and 15 which are referred to as first 14 and second 15 frame members throughout the specification. It should be understood by those skilled in the art that reference to the respective first and second frame members may be reversed, in that structural features positioned on the first frame member could be shifted to the second frame member, where those on the second frame member are likewise shifted to the first frame member. With this interchangeable aspect identified, the following description provides clarification to the points of novelty.

The screen enclosure 10 comprises a first frame member 14 which surrounds an opening 13 through the frame member wherein the screen material 11 is positioned. This frame member includes an exposed, exterior face 20 and an opposing interior face 21 and on an opposite side of the frame member 14. A second frame member 15 also includes an exposed, exterior face 16 and an opposing face 17 on an opposite side thereof for abutting against the opposing interior face 21 of the first frame member. This occurs, as will be explained later, when the first and second frame members are coupled together to form a single frame as shown in FIG. 1.

As illustrated, the opposing interior faces 21 and 17 include a section of serrated contacting structure 23 and 24 including a plurality of rows of teeth extending substantially along the length of the frame member and being interposed in contacting relationship between the substantial full perimeter of the opposing faces of the first and second frame members. This serrated contacting structure 23 and 24 provides the mechanism for maintaining a screen 11 in a tight configuration across the opening 13 of the frame. As can be seen in FIG. 2, this occurs as the serrated contacting structure interengages to capture the screen material 11 between the respective teeth. The tight configuration of the screen is maintained by the force supplied by the serrated contacting structure with respect to the captured screen material. Because of the multiple rows of teeth forming the serrated contacting structure, the steel screen 11 remains in its secure position despite the most rigorous of forces applied with respect to opening the door or otherwise pushing on the screen material.

Additional screen material extends into a cavity 30 (shown more clearly in FIG. 3). This cavity is essentially formed along the full length of the frame member and is positioned outside the enclosure of the serrated contacting structure relative to the tight screen material 11 within the frame. This cavity (sometimes referred to herein as the first cavity) is formed with sufficient depth to receive excess screen material 31 which extends beyond the stretched portion of the screen.

The first frame member 14 includes a protruding lip 33 which extends from its opposing face 21 in direct alignment with the cavity 30 of the second frame member. This lip 33 has a configuration which permits its placement within the cavity 30 to compress and secure the excess screen material with the opposing faces 17 and 21 in near contact. This protruding lip 33 and cavity 30 are configured with common geometries along a substantial portion of their interengaging surfaces 35 and 36 to provide additional frictional retaining forces with respect to the captured screen.

The screen is further trapped between a central support column 37 and a contacting ridge 38 which engages an upper surface 39 of the support column 37. By compressing or capturing the screen within this ridge, inadvertent release of the screen is further minimized. Any remaining screen material is simply pushed into a second cavity 40 formed in the second frame member 15. This extra screen material 41 can be compressed down into the cavity 40 and is thereby concealed from sight. A cap member 42 is configured into the interior face of the first frame member 14 to seal off this second cavity.

It can be seen from FIG. 2 that the geometry adopted for the respective first and second frame members is configured to interengage at each aspect of the frame operation. For example, the primary restriction against movement or release of the screen 11 arises at the serrated structure 23 and 24. This structure also provides structural means for securing the first and second frame members together by means of a screw 45 (FIG. 2) or other means for secure attachment to these members to the single frame structure as illustrated in FIG. 1. A second stage provides for additional interengagement of the respective first and second members by means of the lip 33 which is inserted into cavity 30. Interactive surfaces 35 and 36 provide a second stage of retention to the screen material. Finally, the support post 37 with its upper structure 39 engages the screen against the first screen member and cooperates with the cap 42 to provide a third stage of retention of screen material against release.

FIG. 3 illustrates a method for securing screen material within the screen insert such as illustrated in FIG. 1. The method is generally performed by forming a frame for the screen insert by selecting two opposing frame members having substantially common configurations, thereby facilitating their coupling together to form the single frame. In FIG. 3, the first 14 and second 15 frame members are shown in separated configuration. These screen members are typically formed by extrusion of aluminum or by other manufacturing techniques which can provide a sturdy rigid structure suitable for screen door applications. Other methods of fabrication will be known to those skilled in the art.

The next step involves forming or coupling a serrated contacting structure 23 and/or 24 at an interface of at least one of the frame members. In the preferred embodiment, this serrated contacting structure is formed as an integral part of the extruded or molded frame members 14 and 15 for convenience and economic reasons. This is not essential, however. In fact, the serrated structure could be separate from the respective frames and could be merely inserted between the opposing faces of these frame members. For this reason, dashed lines 39 have been represented to illustrate that the serrated tooth structure may or may not be integral with the frame members. If inserts are used, the opposing faces of the respective frame members would probably be planar or flat in configuration and suited with means for receiving the insert serrated structure in accordance with the construction previously outlined.

The next step is to interpose screen material 11 between the serrated contacting structure and the remaining frame member. Where both frame members include serrated contacting structure such as with items 23 and 24, the screen material is simply positioned between the respective frame members.

Finally, the respective frame members 14 and 15 are brought together to a seated configuration as is shown in FIG. 2. In this manner, the screen material is compressed together, along with the serrated contacting structure and frame members to form a screen insert with the screen material securely captured. Additional tension is provided to the screen material by the tightening effect of lip 33 which draws the screen into cavity 30. At the final stage wherein the lip 33 is almost fully seated within the cavity 30, the screen is then engaging the tooth edges of the respective serrated structure 23 and 24. This further tightens the screen material and secures it within each of the tongue and groove engagements as shown in FIG. 2.

By adopting the methodology and structure set forth herein, the screen material 11 is actually retained in a manner similar to a vice clamp. By using heavy duty extruded aluminum, frame strength is much greater than conventional rolled form frames which readily kink or bend in response to severe stress. With this construction, a solid core of aluminum makes such kinking or bending highly unlikely. With such solid frame structure, stainless steel screen virtually eliminates tearing, such as commonly occurs with fiberglass or aluminum screen wire. This preferred embodiment illustrates the use of 0.018 #12 stainless wire.

It will be apparent to those skilled in the art that numerous variations from the disclosed structure and methodology may be adopted and still fall within the inventive subject matter. As was mentioned, the opposing faces of frame members 14 and 15 could embody a planar configuration as illustrated by dashed lines 39, with the serrating contacting structure having separate physical form. Obviously, with extruded constructions an integral formation of the serrated teeth structure having a plurality of rows is preferred over a separate serrated insert structure. Such integral construction ensures better gripping of the screen material in its sandwiched configuration. Although a sawtooth configuration is illustrated, other serrated structures are contemplated and are within the skill of the typical artisan.

In addition, it should be noted that the particular geometries are not critical. For example, nine rows of teeth are illustrated in the drawings and provide greatly enhanced retention over only three rows of teeth. Choice of these variables will depend on the cost of production and intended environment. Where greater strength is not required, fewer rows of teeth may be used.

Furthermore, it will be noted that the subject invention may be incorporated directly within a storm door, as opposed to merely having an insert such as is illustrated in FIG. 1. The construction of such a screen door could incorporate the various structural features shown in FIGS. 2 and 3. Such a door could either be a composite or component structure with door frame and insert utilizing a screen insert item such as shown in FIG. 1, or the door could be of integral construction with the screen device as disclosed herein.

In view of the foregoing, it is to be understood that the invention described and claimed herein is not to be limited by the specific examples set forth.

I claim:

1. A screen enclosure device comprising:

a first rigid frame member surrounding an opening therethrough, said frame member having an exterior face and an opposing interior face on an opposite side thereof for abutting against a second frame member;

a second rigid frame member having a size and configuration corresponding to the first frame member and including an exterior face and an opposing interior face on an opposite side thereof for abutting against the opposing interior face on the first frame member when the first and second frame members are coupled together to form a single frame;

serrated contacting structure including a plurality of rows of teeth formed as an integral part of the interior face of at least one of said rigid frame members such that when said first and second frame members are coupled together to form a single frame, the serrated contacting structure is interposed in contacting relationship between the opposing interior faces of the first and second frame members; and a screen drawn tightly across the opening of the frame lying in a first plane and retained in this tight configuration by force means supplied by the serrated contacting structure interposed between the opposing interior faces of the first and second frame members;

wherein said opposing faces of the first and second frame members are substantially planer in configuration, said serrated contacting structure also having each contacting surface of its teeth common to respective single planes each of which are parallel to said first plane;

wherein one of the frame members includes a first cavity formed along the full length of the frame member, outside the enclosure of the serrated contacting structure and having sufficient depth to receive excess screen material extending beyond the stretched portion of the screen, said cavity being closed at its open end by the remaining frame member when in the coupled configuration;

wherein the remaining frame member includes a protruding lip extending from its opposing face and in direct alignment with the cavity of the other frame member when coupled, said lip having a configuration which permits the lip to mate within the cavity with entrapment of excess peripheral screen material and with the opposing faces in near contact.

2. A device as defined in claim 1, wherein the serrated contacting structure is formed as an integral part of at least one of the respective opposing faces of the first and second frame members, said rows of teeth being in direct contact with the screen which is interposed between the teeth and the remaining opposing face.

3. A device as defined in claim 1, wherein the serrated contacting structure has a saw tooth configuration.

4. A device as defined in claim 3, wherein the serrated contacting structure includes at least three rows of teeth.

5. A device as defined in claim 1, wherein the serrated structure is formed as an integral part of each of the respective opposing faces of the first and second frame members and as a continuous perimeter around the opening and provides full contact between corresponding sections of the respective opposing faces of the first and second frame members, said serrated structure of the first frame member being offset with respect to serrated structure of the second frame member to provide for interengagement of ridge-in-groove.

6. A device as defined in claim 1, wherein the frame members are fabricated of aluminum and the screen material comprises steel.

7. A device as defined in claim 1, wherein the frame members are configured to fit within an opening as part of a screen door.

8. A device as defined in claim 1, further comprising a second cavity formed along the full perimeter of the opposing face of one frame member outside the perimeter of the first cavity, said second cavity being dimensioned to receive and conceal excess screen material, the opposing face on the remaining frame member including means for capping the second cavity when the first and second frame members are joined.

9. A screen enclosure device as in claim 1 wherein the serrated contacting structure further comprises first rows of teeth formed as an integral part of the interior face of the first frame member and second rows of teeth formed as an integral part of the interior face of the second frame member, such that when said first and second frame members are coupled together to form a single frame, said first and second rows of teeth engage each other in a seated position with screen material captured therebetween.

10. A screen door, comprising:

a door frame having an open section configured for receiving screen material;

said door frame including a screen frame surrounding the open section, said screen frame being formed by two opposing rigid frame members having opposing interior faces and being joined together in an abutting relationship at said opposing interior faces with screen material sandwiched therebetween and lying in a first plane;

said screen frame further comprising serrated contacting structure formed as an integral part of at least one of said frame members and interposed between one of the frame members and the screen material such that the screen material is captured by at least a portion of the serrated structure against the opposing frame member in a tight configuration;

wherein said opposing faces of the first and second frame members are substantially planer in configuration, said serrated contacting structure also having each contacting surface of its teeth common to respective single planes each of which are parallel to said first plane;

wherein one of the frame members includes a first cavity formed along the full length of the frame member, outside the enclosure of the serrated contacting structure and having sufficient depth to receive excess screen material extending beyond the stretched portion of the screen, said cavity being closed at its open end by the remaining frame member when in the coupled configuration;

wherein the remaining frame member includes a protruding lip extending from its opposing face and in direct alignment with the cavity of the other frame member when coupled, said lip having a configuration which permits the lip to mate within the cavity with entrapment of excess peripheral screen material and with the opposing faces in near contact.

11. A device as defined in claim 10, wherein the serrated contacting structure is formed as an integral part of at least one of opposing faces of the respective frame members.

12. A device as defined in claim 11, wherein the serrated structure includes rows of teeth extending substantially around the full perimeter of the frame member, said rows of teeth being in direct contact with the screen which is interposed between the teeth and a face of the remaining frame member.

13. A device as defined in claim 10, wherein the serrated contacting structure is integrally formed at each opposing face of the respective frame members and has an offset saw-tooth configuration which enables enterengagement of the teeth with the screen material captioned therebetween.

14. A device as defined in claim 10, wherein one of the frame members includes a cavity formed along the full length of the frame member, outside the serrated contacting structure and having sufficient depth to receive excess screen material extending beyond the stretched portion of the screen, said cavity being closed at its open end by the remaining frame member when in the coupled configuration.

15. A device as defined inclaim 14, wherein the remaining frame member includes a protruding lip extending from its opposing face and in direct alignment with the cavity of the other frame member when coupled, said lip having a configuration which permits the lip to mate within the cavity with the excess screen and with the opposing faces of the frames in near contact.

16. A device as defined in claim 10, wherein the door comprises aluminum and the screen is fabricated of steel.

17. A method for securing screen material within a screen insert as part of a screen door, said method comprising the steps of:

a) forming a frame for the screen insert by selecting two opposing rigid frame members having substantially planer, opposing interior faces and substantially common configurations to facilitate their coupling together to form a single frame;

b) forming a serrated contacting structure having a plurality of rows of teeth such that each contacting surface of its teeth is common to respective single planes, as an integral part of the interior face of at least one of the frame members;

c) interposing screen material between at least a portion of the serrated contacting structure and the interior face of the remaining frame member;

d) compressing the screen material, serrated contacting structure and frame members together to form a screen insert with the screen material securely captured in tight configuration as part of the screen insert and lying in a first plane which is parallel to each of said single planes;

e) forming a first cavity along the full length of one of said frame members of sufficient depth to receive excess screen material extending beyond the stretched portion of the screen, said cavity being closed at its open end by the remaining frame member when in the coupled configuration; and f) forming a protruding lip in the remaining frame member to extend from its opposing face in direct alignment with the cavity of the other frame member when coupled, said lip having a configuration which permits the lip to mate within the cavity with entrapment of excess peripheral screen material and with the opposing faces in near contact.

* * * * *